United States Patent [19]

Iwabuchi

[11] Patent Number: 4,919,102

[45] Date of Patent: Apr. 24, 1990

[54] FUEL PUMP DRIVING APPARATUS FOR VEHICLE

[75] Inventor: Hideo Iwabuchi, Saitama, Japan

[73] Assignee: Jidosha Kiki Co., Ltd., Tokyo, Japan

[21] Appl. No.: 360,514

[22] Filed: Jun. 2, 1989

[30] Foreign Application Priority Data

Jul. 15, 1988 [JP] Japan ..... 63-175193

[51] Int. Cl.[5] ..... F02M 39/00

[52] U.S. Cl. ..... 123/499; 123/497; 123/41.31; 123/509

[58] Field of Search ..... 123/497, 498, 499, 458, 123/41.31, 509

[56] References Cited

U.S. PATENT DOCUMENTS

| | | | |
|---|---|---|---|
| 3,935,851 | 2/1976 | Wright | 123/497 |
| 4,019,478 | 4/1977 | Hobo | 123/497 |
| 4,333,434 | 6/1982 | Brunais | 123/498 |
| 4,532,893 | 8/1985 | Day | 123/509 |
| 4,543,914 | 10/1985 | Harris | 123/41.31 |
| 4,756,291 | 7/1988 | Cummins | 123/497 |
| 4,763,611 | 8/1988 | Kobayashi | 123/41.31 |
| 4,811,709 | 3/1989 | Braun | 123/357 |

FOREIGN PATENT DOCUMENTS

| | | | |
|---|---|---|---|
| 2641921 | 3/1977 | Fed. Rep. of Germany | 123/498 |
| 55-72649 | 5/1980 | Japan . | |
| 56-45161 | 4/1981 | Japan . | |
| 0028832 | 2/1982 | Japan | 123/497 |

*Primary Examiner*—Carl Stuart Miller

*Attorney, Agent, or Firm*—Townsend & Townsend

[57] ABSTRACT

A fuel pump driving apparatus for a vehicle, comprising a fuel pump, a blocking oscillator, including a transistor and a bias circuit therefor, for driving the fuel pump, and a control circuit for controlling an oscillating operation of the blocking oscillator. The control circuit drives the blocking oscillator upon reception of an ignition pulse generated from an ignition coil in accordance with rotation of an engine. The control circuit is constituted by a silicon controlled rectifier whose input side is series-connected to a bias circuit of the blocking oscillator, and circuit means, connected to the gate of the silicon controlled rectifier and including a Zener diode, for voltage-dividing the ignition pulse. The bias circuit for the transistor of the blocking oscillator is designed to set a current which is flowed therethrough when the transistor is OFF to be lower than a holding current of the silicon controlled rectifier.

6 Claims, 4 Drawing Sheets

FUEL PUMP DRIVING APPARATUS FOR VEHICLE

BACKGROUND OF THE INVENTION

The present invention relates to a fuel pump driving apparatus for a vehicle.

A fuel pump driving apparatus used in, e.g., a vehicle must be housed in a limited space of the vehicle. Therefore, it is important to decrease the number of components and the size of such a driving apparatus.

A conventional fuel pump driving apparatus FPD for a vehicle has an arrangement shown in FIG. 1, i.e., is constituted by a fuel pump control circuit 4 and a blocking oscillator 5 incorporated in a fuel pump. Referring to FIG. 1, reference symbol E denotes a battery; and F, a fuse. In addition, reference numeral 1 denotes an ignition switch; 2, an ignition coil having a primary winding and a secondary winding connected to an ignition plug P; and 3, a point breaker connected in parallel with a capacitor *3a*.

The blocking oscillator 5 comprises a bias resistor 7 for a transistor (npn type in this case), a signal coil 8, an excitation coil or a main coil 9 for driving a fuel pump, diodes 10 to 12, and a surge absorber 13 for protecting a transistor.6 from a surge. Blocking oscillation is performed by electromagnetic coupling of the signal and main coils 8 and 9.

The fuel pump control circuit 4 includes a wave shaping circuit WFT connected to a node N1 between the point breaker 3 and the primary side of the ignition coil 2 through a terminal T4, a one-shot circuit OC connected to the output side of the wave shaping circuit WFT, a transistor TR to be ON/OFF-controlled by an output from the one-shot circuit OC, and a diode D. When an ignition pulse is supplied to the terminal T4, the transistor TR is kept On by the one-shot circuit OC for a predetermined time (t), and a power source on the terminal T1 side is connected to the blocking oscillator 5 through a terminal T2.

With the above-described arrangement, when a cam interlocked with the rotation of an engine is rotated, the point breaker 3 performs an ON/OFF operation. In accordance with this ON/OFF operation, a current is intermittently and periodically flowed in the primary winding of the ignition coil. A high voltage is generated in the secondary winding of the ignition coil 2 by an ignition pulse current based on a counter electromotive force which is generated in the primary winding of the ignition coil when the point breaker 3 is turned off. The high voltage is then applied to the ignition plug P.

At this time, an ignition pulse is generated at the primary side of the ignition coil 2, i.e., the node N1 between the coil 2 and the point breaker 3 when the current flowing through the primary side of the ignition coil 2 is OFF. This pulse is then supplied to the wave shaping circuit WFT of the fuel pump control circuit 4 through a terminal T4. The pulse is wave-shaped by the circuit WFT and is supplied to the one-shot circuit OC. The one-shot circuit OC is triggered at the trailing edge of the ignition pulse and keeps supplying an output to the input terminal of the transistor TR for a predetermined time (t) to turn on the transistor TR. As a result, the battery E is connected to the blocking oscillator 5 to cause the battery E to supply power to the oscillator 5. The blocking oscillator 5 is then oscillated to drive the fuel pump.

FIG. 2 shows a fuel pump assembly. The assembly is constituted by a fuel pump and the blocking oscillator 5. Since each component is known, a detailed description thereof will be omitted. Referring to FIG. 2, reference numeral 31 denotes a case main body; 32, a cover which is combined with the main body 31 to constitute an envelope; 34, a sleeve; 35 and 36, magnetic tubes; 37, a seal ring; 40, a coil bobbin around which the signal and main coils 8 and 9 are wound; 41, a printed board on which electric components are mounted; 42, a holder; 45 and 46, valves; 48, a plunger; 49, a coil spring; 51, a seal ring; and 53, a grommet. The components of the blocking oscillator 5 are mounted on the printed board 41.

A conventional fuel pump assembly has the above-described arrangement. If it is possible, the fuel pump control circuit 4 is preferably incorporated in the case main body 31. As described above, however, the fuel pump control circuit 4 includes the wave shaping circuit WFT and the one-shot circuit OC. These circuits, as is known, are constituted by several tens of electric components (e.g., resistors, transistors, capacitors, Zener diodes, and diodes). It is impossible to mount the fuel pump control circuit 4 on the above-described printed board together with the blocking oscillator 5. For this reason, the fuel pump control circuit 4 is formed separately of the fuel pump assembly. Therefore, a space for mounting the fuel pump control circuit is required, and the cost for mounting the control circuit in a vehicle is inevitably increased in addition to the cost of parts for attaching it to the vehicle. In addition, since the fuel pump and the fuel pump control circuit must be connected by wiring, reliability in connection of wiring must be taken into consideration.

SUMMARY OF THE INVENTION

It is, therefore, a principal object of the present invention to provide a fuel pump control circuit which is constituted by components smaller in number than that of a conventional circuit and is capable of ON/OFF-controlling a blocking oscillator.

In order to achieve the above object, according to an aspect of the present invention, there is provided a fuel pump driving apparatus for a vehicle, comprising a fuel pump, a blocking oscillator, including a transistor and a bias circuit therefor, for driving the fuel pump, and a control circuit for controlling an oscillating operation of the blocking oscillator, the control circuit driving the blocking oscillator upon reception of an ignition pulse generated from an ignition coil in accordance with rotation of an engine, wherein the control circuit comprises a silicon controlled rectifier whose input side is series-connected to a bias circuit of the blocking oscillator, and circuit means, connected to a gate of the silicon controlled rectifier and including a Zener diode, for voltage-dividing the ignition pulse, and the bias circuit for the transistor of the blocking oscillator is designed to set a current which is flowed therethrough when the transistor is OFF to be lower than a holding current of the silicon controlled rectifier.

DETAILED DESCRIPTION OF THE PREFERRED EMBODIMENT

Figure 1:
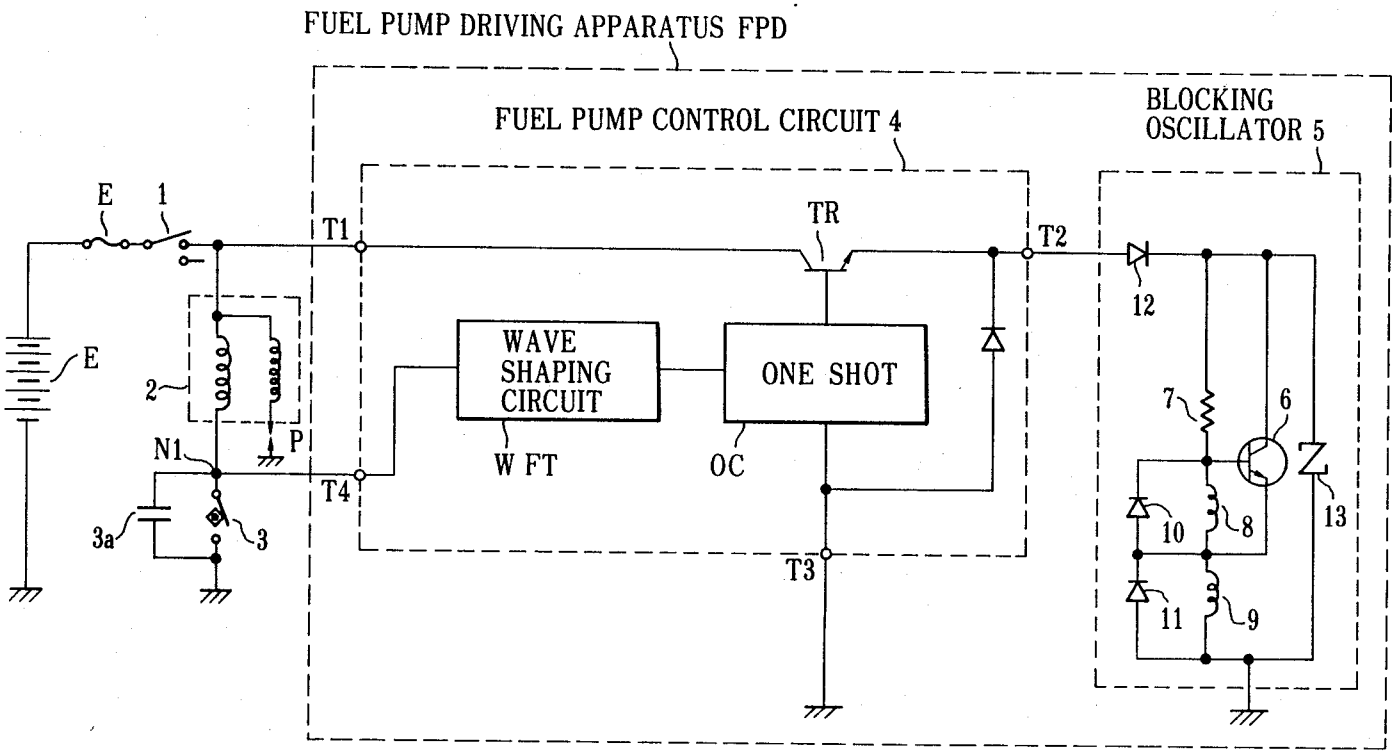
FIG. 1 (PRIOR ART)
FIG. 1 is a circuit diagram showing an arrangement of a conventional fuel pump driving apparatus.
Figure 2:
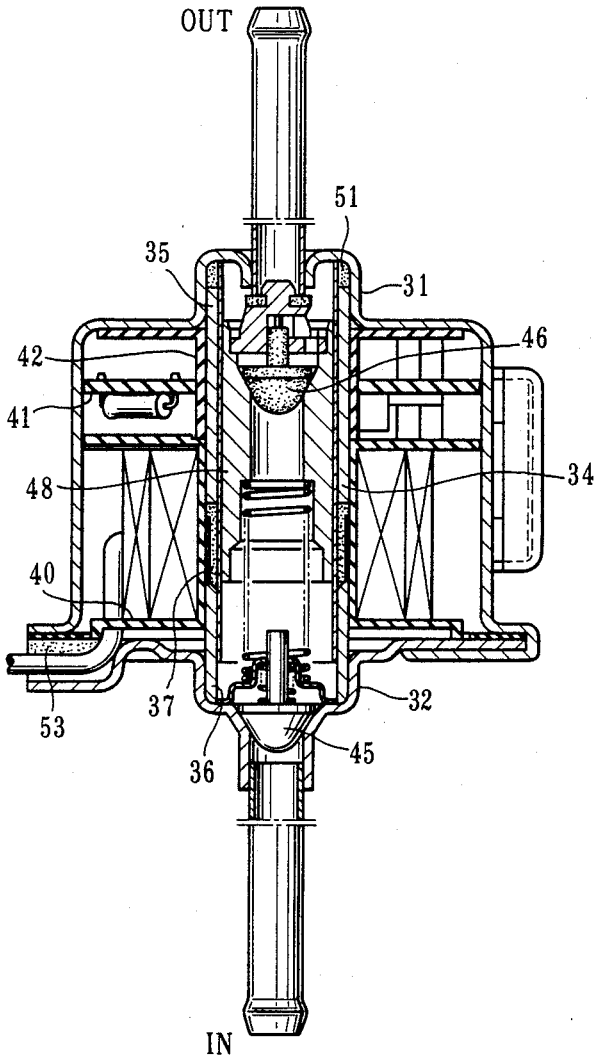
FIG. 2 is a sectional view showing a fundamental arrangement of a conventional fuel pump assembly.
Figure 3:
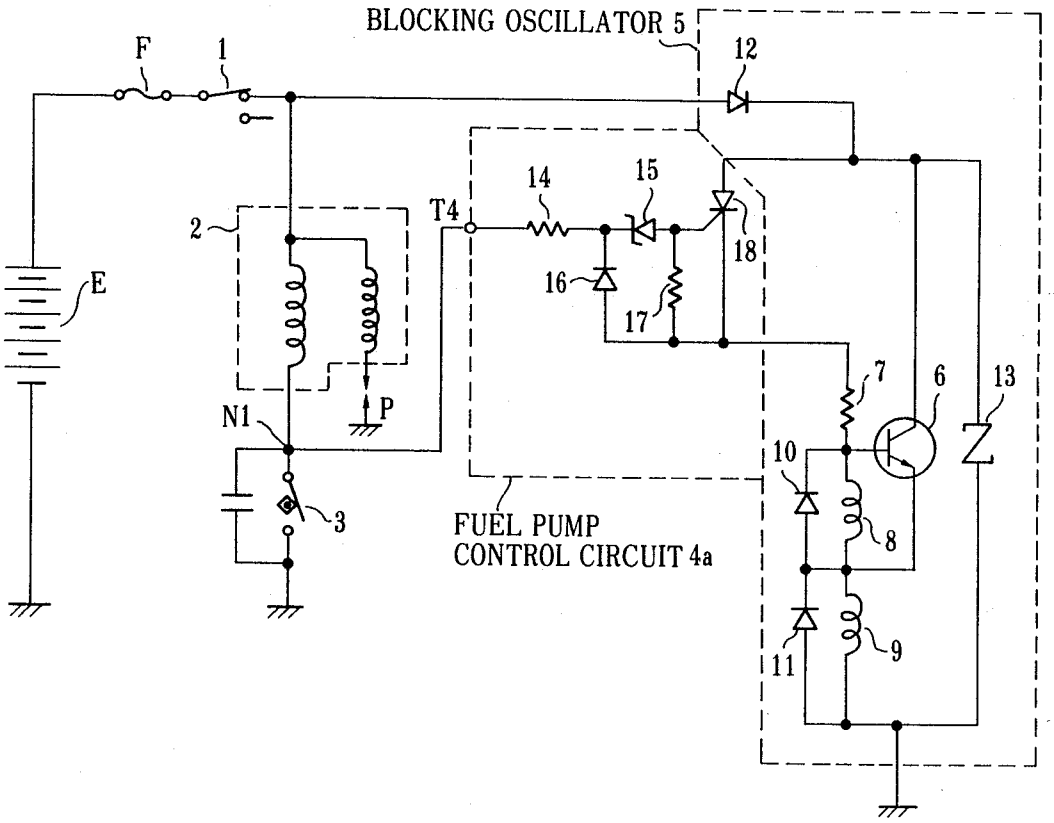
FIG. 3 is a circuit diagram showing an arrangement of a fuel pump driving apparatus according to an embodiment of the present invention.

FIG. 3 shows a fuel pump driving apparatus according to an embodiment of the present invention. The same reference numerals in FIG. 3 denote the same parts as in FIGS. 1 and 2.

Referring to FIG. 3, a fuel pump control circuit 4a of a driving apparatus characterized by the present invention is constituted by resistors 14 and 17, a Zener diode 15, a diode 16, and a silicon controlled rectifier 18. One end of the resistor 14 is connected to a node N1 between the primary side of an ignition coil 2 and a point breaker 3 through a terminal T4. The other end of the resistor 14 is connected to the cathodes of the Zener diode 15 and of the diode 16. The other end of the Zener diode 15 is connected to the gate of the rectifier 18 and is further connected to one end of the resistor 17. The other end of the resistor 17 is connected to the anode of the diode 16 and the cathode of the rectifier 18 and is further connected to one end of a resistor 7 of a blocking oscillator 5. The anode of the rectifier 18 is connected to a node between a diode 12 and the collector of a transistor 6 of the blocking oscillator 5.

The resistor 14 used in the fuel pump control circuit 4a is combined with the Zener diode 15 and the resistor 17 to voltage-divide an ignition pulse. More specifically, the ignition pulse is a high voltage having a peak of 300 to 400 V. When this ignition pulse is directly applied to the gate electrode of the rectifier 18, the rectifier 18 breaks down. In order to prevent this, the ignition pulse is voltage-divided with the above-described arrangement. Furthermore, in order to prevent the rectifier 18 from being erroneously operated by noise signals other than the ignition pulse, the rectifier 18 is designed to be triggered by a voltage applied to its gate only when a voltage of, e.g., about 30 V or more is received by using the characteristics of the Zener diode 15. Since a negative voltage of about −80 V is generated as a transient phenomenon when the ignition pulse is turned off, the diode 16 is arranged in the control circuit so as to absorb this voltage.

The blocking oscillator 5 used in this embodiment has the same arrangement as that of the conventional circuit except that the resistor 7 constituting a feedback circuit and a bias circuit of the transistor 6 is not directly connected to a power source as in the conventional circuit described above, but is connected thereto through the rectifier 18, and the current which is flowed trough the resistor 7 during an OFF period of the transistor 6 is set to be lower than the holding current of the rectifier 18.

An operation of the fuel pump driving apparatus FPD according to the present invention will be described below. When a point breaker 3 which is turned on and off upon rotation of an engine (not shown) is turned off, an ignition pulse is generated at the primary winding of the ignition coil 2, i.e., at the node N1, by a self-electromotive force of energy accumulated in the ignition coil 2. This ignition pulse is supplied to the fuel pump control circuit 4a through a terminal T4. More specifically, the ignition pulse is supplied to the gate of the rectifier 18 through the resistor 14 and the Zener diode 15 to turn on the rectifier 18. When the rectifier 18 is turned on, the ON current (anode current) of the rectifier 18 is flowed in the resistor 7 and coils 8 and 9 of the blocking oscillator 5, and the oscillator 5 starts an oscillating operation. In this case, the resistance of the resistor 7 is selected to allow the anode current of the rectifier 18 which flows when the transistor 6 is turned off to be smaller than the holding current. Because of this selection of a resistance, the rectifier 18 can be naturally turned off and the blocking oscillator 5 can stop an oscillating operation without requiring a forcible commutating circuit nor using a means for disconnecting a current by using a contact. More specifically, the recitifier 18 is kept ON for a predetermined time by the ignition pulse and is triggered again upon reception of the next ignition pulse. Therefore, when the engine is rotated at a speed higher than that of an idling rotation, the rectifier 18 is kept in an ON state to cause the blocking oscillator 5 to continue an oscillating operation. If, however, no ignition pulse is generated due to turnover or collision of the vehicle, the rectifier 18 is kept in an OFF state. Hence, the blocking oscillator 5 stops the oscillating operation, and the fuel pump is kept in an inoperative state. Safety with respect to the fuel pump is ensured in this manner.

Figure 4:
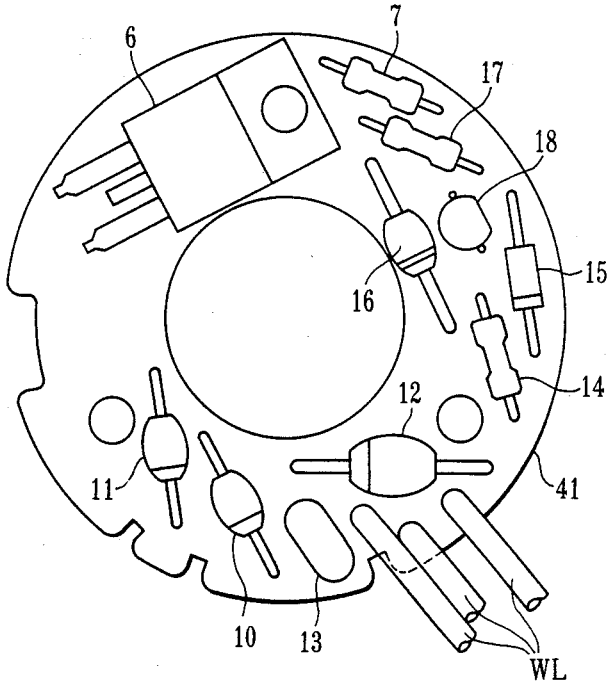
FIG. 4 is a schematic plan view showing an arrangement of a fuel pump control circuit and a blocking oscillator in FIG. 3 which are mounted on a printed board in a case of a fuel pump assembly.

In this embodiment, the fuel pump control circuit 4a is constituted by five components, i.e., the number of components is greatly decreased as compared with the conventional circuit. Therefore, as shown in FIG. 4 as an example, the circuit 4a can be mounted on a printed board 41 in the fuel pump assembly, on which the blocking oscillator 5 is mounted.

As has been described above, the fuel pump driving apparatus of the present invention can be constituted by components smaller in number than that of the conventional apparatus and can be operated in the same manner as in the conventional apparatus. With this arrangement, the components of the fuel pump control circuit can be mounted on the printed board in the fuel pump assembly, on which the blocking oscillator is mounted. As a result, a space required for the overall fuel pump assembly can be made smaller than that for the conventional apparatus. In addition, wiring is required only in the fuel pump assembly, a special consideration given to wiring can be reduced compared with the conventional apparatus, and hence the cost can be reduced.

In the above-described embodiment, in order to generate an ignition pulse, the point breaker and the ignition coil are combined. However, the present invention can be equally applied to a known circuit for generating an ignition pulse by using an electronic circuit called a full transistor or semi-transistor type ignition system.

What is claimed is:

1. A fuel pump driving apparatus for a vehicle, comprising a fuel pump, a blocking oscillator, including a transistor and a bias circuit therefor, for driving said fuel pump, and a control circuit for controlling an oscillating operation of said blocking oscillator, said control circuit driving said blocking oscillator upon reception of an ignition pulse generated from an ignition coil in accordance with rotation of an engine, wherein said control circuit comprises a silicon controlled rectifier whose input side is series-connected to a bias circuit of said blocking oscillator, and circuit means, connected to a gate of said silicon controlled rectifier and including a Zener diode, for voltage-dividing the ignition pulse, and said bias circuit for said transistor of said blocking oscillator is designed to set a current which is flowed therethrough when the transistor is OFF to be lower than a holding current of said silicon controlled rectifier.

2. An apparatus according to claim 1, wherein an output side of said silicon controlled rectifier is connected between a power source of said blocking oscillator and a feedback circuit of a transistor constituting said blocking oscillator.

3. An apparatus according to claim 1, wherein said circuit means comprises a first resistor having one end for receiving the ignition pulse, and a Zener diode having a cathode connected to the other end of said resistor and an anode connected to the gate of said silicon controlled rectifier.

4. An apparatus according to claim 3, further comprising a second resistor connected between the gate and cathode of said silicon controlled rectifier.

5. An apparatus according to claim 4, further comprising a diode having a cathode connected to a node between said first resistor and said Zener diode and an anode connected to the cathode of said silicon controlled rectifier.

6. An apparatus according to claim 1, wherein said blocking oscillator and said control circuit are mounted on a single printed board.

* * * * *